US007281346B1

(12) United States Patent
Cook et al.

(10) Patent No.: US 7,281,346 B1
(45) Date of Patent: Oct. 16, 2007

(54) PORTABLE GUN SUPPORT CASE

(75) Inventors: Gregory A. Cook, Hiram Township, OH (US); Charles E. Philips, III, Madison Township, OH (US)

(73) Assignee: Flambeau, Inc., Baraboo, WI (US)

( * ) Notice: Subject to any disclaimer, the term of this patent is extended or adjusted under 35 U.S.C. 154(b) by 503 days.

(21) Appl. No.: 10/887,687

(22) Filed: Jul. 9, 2004

(51) Int. Cl.
*F41A 9/62* (2006.01)

(52) U.S. Cl. ..... 42/94; 42/90; 42/106; 211/64; 206/315.11; 206/317

(58) Field of Classification Search ..... 42/94, 42/90, 106; 211/64; 206/315.11, 317
See application file for complete search history.

(56) References Cited

U.S. PATENT DOCUMENTS

| | | | | | |
|---|---|---|---|---|---|
| 2,121,981 | A | | 6/1938 | Pugsley | |
| 2,774,563 | A | | 12/1956 | Pribis | |
| 2,877,689 | A | * | 3/1959 | Pribis | 89/37.04 |
| 3,964,613 | A | * | 6/1976 | Anderson, Jr. | 211/64 |
| 4,548,392 | A | | 10/1985 | Rickling | |
| 4,702,029 | A | * | 10/1987 | DeVaul et al. | 42/94 |
| 4,815,593 | A | * | 3/1989 | Brown | 206/315.11 |
| 4,873,777 | A | * | 10/1989 | Southard | 42/94 |
| 5,058,302 | A | | 10/1991 | Minneman | |
| D359,392 | S | * | 6/1995 | Bellington | D3/262 |
| D362,116 | S | * | 9/1995 | Bellington et al. | D3/262 |
| 5,497,575 | A | * | 3/1996 | Fried | 42/94 |
| 5,640,944 | A | * | 6/1997 | Minneman | 124/1 |
| 5,697,180 | A | * | 12/1997 | Morizio | 42/94 |
| 6,374,532 | B1 | * | 4/2002 | Klein | 43/17 |
| 2006/0065560 | A1 | * | 3/2006 | Dickinson et al. | 206/317 |

* cited by examiner

*Primary Examiner*—M. Clement

(57) ABSTRACT

A portable gun support case having gun support members firmly held in place on the case by retaining members attached to the case. The case has a lower box and an upper box which includes two longitudinal box or cover sections pivotally mounted on the lower box. When the box is open, the support members may be placed in upright positions adjacent walls of the lower box. The retaining members then may be moved into firm holding engagement with the support members. When the support members are removed from their upright positions, the upper box may be pivotally closed above the lower box along a center line formed by the two longitudinal cover sections and in engagement with the lower box. When the upper box engages the lower box, outward projections at opposite ends of the upper box are engaged by the retaining members to hold the case firmly closed.

16 Claims, 6 Drawing Sheets

PORTABLE GUN SUPPORT CASE

BACKGROUND OF THE INVENTION

1. Field of the Invention

This invention relates to a support case for a gun. More particularly, the invention relates to a readily portable support case for rifles or shotguns which may be quickly set up to provide support for the gun.

2. Description of the Related Art

When guns such as rifles and shotguns are cleaned or maintained, it is desirable that they be held in a fixed position during the maintenance work. Of course, it is also necessary to have the needed tools and maintenance material readily available. When such guns are transported for use at different locations such as the open field or target ranges, it is often necessary to clean or otherwise maintain them without the benefit of a fixed gun support and where maintenance materials aren't available. Thus, there is a need for a portable gun holder or support which provides firm support for the gun while it is being cleaned or repaired. Such a gun support can also be used to support the gun when it is being fired. Further, it would facilitate work on the gun and be convenient if the portable support could also be used to carry the necessary tools, parts and materials required, and carry ammunition for the shooter.

In Minneman U.S. Pat. No. 5,058,302, a gun support is disclosed for holding a gun fixed for maintenance purposes. The gun support is portable in that it can be carried on top of a separate accessory box by extending the carry handle of the box through an opening in the bottom of the gun support tray. This is a relatively cumbersome combination with respect to portability and may not provide sufficiently firm support for the gun. U.S. Pat. No. 4,548,392 to Rickling discloses a portable gun holder in which the supports for the gun are pivotal between an upright holding position and a downward position in a relatively flat carrying case. The gun supports in this patent appear to be relatively expensive and the carrying case does not provide storage space for tools and maintenance parts and materials.

In view of the prior art described above, there continues to be a need for a portable gun support case providing firm support for the gun during cleaning and maintenance, includes storage space for maintenance tools, materials and ammunition, and is of a simple and readily usable design.

BRIEF SUMMARY OF THE INVENTION

In a principle aspect, the present invention comprises a portable gun support case having gun support members firmly held in place on the case. When the case is in an open condition, retaining members hold the support members firmly in place and thereby hold a gun mounted on the support members firmly in place. When the case is in a closed condition, the same retaining members hold the case firmly closed. The case has a lower box and an upper box including two longitudinal box sections pivotally mounted on the lower box. The support members, gun repair tools and maintenance materials may be carried in the lower box. When the box is open, the support members may be placed in upright positions adjacent walls of the lower box. The retaining members then may be moved into holding engagement with the support members. When the support members are removed from their upright positions, the upper box may be pivotally closed above the lower box along a longitudinal center line formed by the two longitudinal box sections of the upper box and in engagement with the lower box. When the upper box engages the lower box, outward projections at opposite ends of the upper box are engaged by the retaining members to hold the case firmly closed. The case is carried by a handle affixed to the upper box.

It thus may be appreciated that a general object of the invention is to provide a portable gun support case for holding a gun firmly in place. A further object of the invention is to provide retaining members for holding gun support members firmly in place on a portable gun support case. A further object of the invention is to provide a portable gun support case having retaining members for holding gun support members in place when the case is open and holding the case closed then the case is closed. A further object is to provide a portable gun support case in which items such as tools, cleaning and maintenance materials, and gun support members may be carried. Another object of the invention is to provide a method of holding a portable gun support case closed, opening the case and holding gun support members on the case when it is open.

BRIEF DESCRIPTION OF THE DRAWINGS

Further objects and advantages of the invention will appear when taken in conjunction with the accompanying drawings in which.

DETAILED DESCRIPTION OF THE INVENTION

Figure 1:
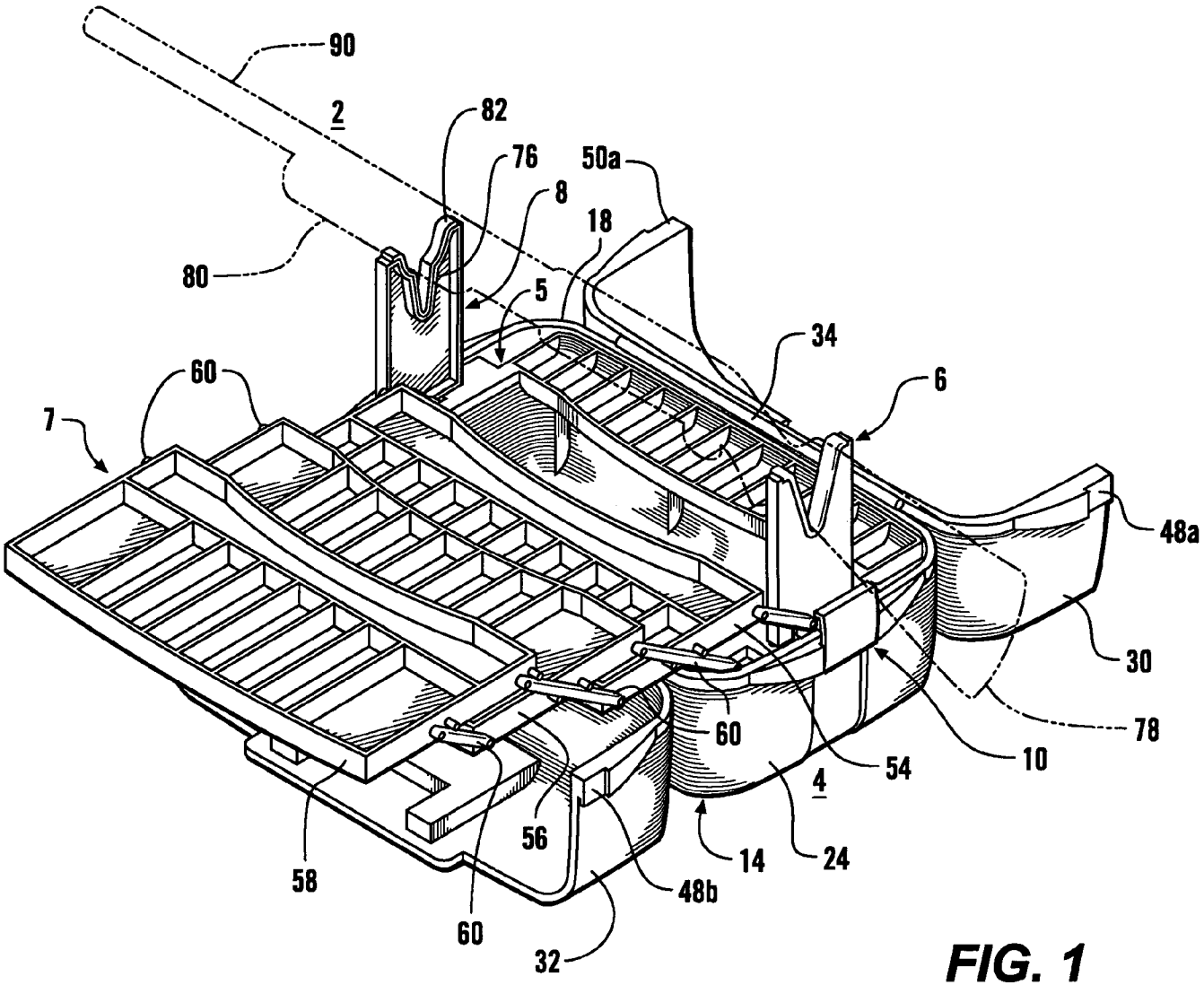
FIG. 1 is a perspective view of a portable gun support case according to the present invention illustrating the support of a gun by the case.

Referring generally to the figures, a gun 2, a case 4, support members or yokes 6 and 8 for supporting the gun, and retaining members 10 and 12 are illustrated. The case includes a support frame 5 and a cantilevered storage tray section 7 mounted on the support frame 5. The support frame 5 also includes an additional storage tray 52. The retaining members 10 and 12 alternatively hold the case 4 closed or hold the yoke members 6 and 8 in place, as will be described in greater detail hereinafter.

Figure 2:
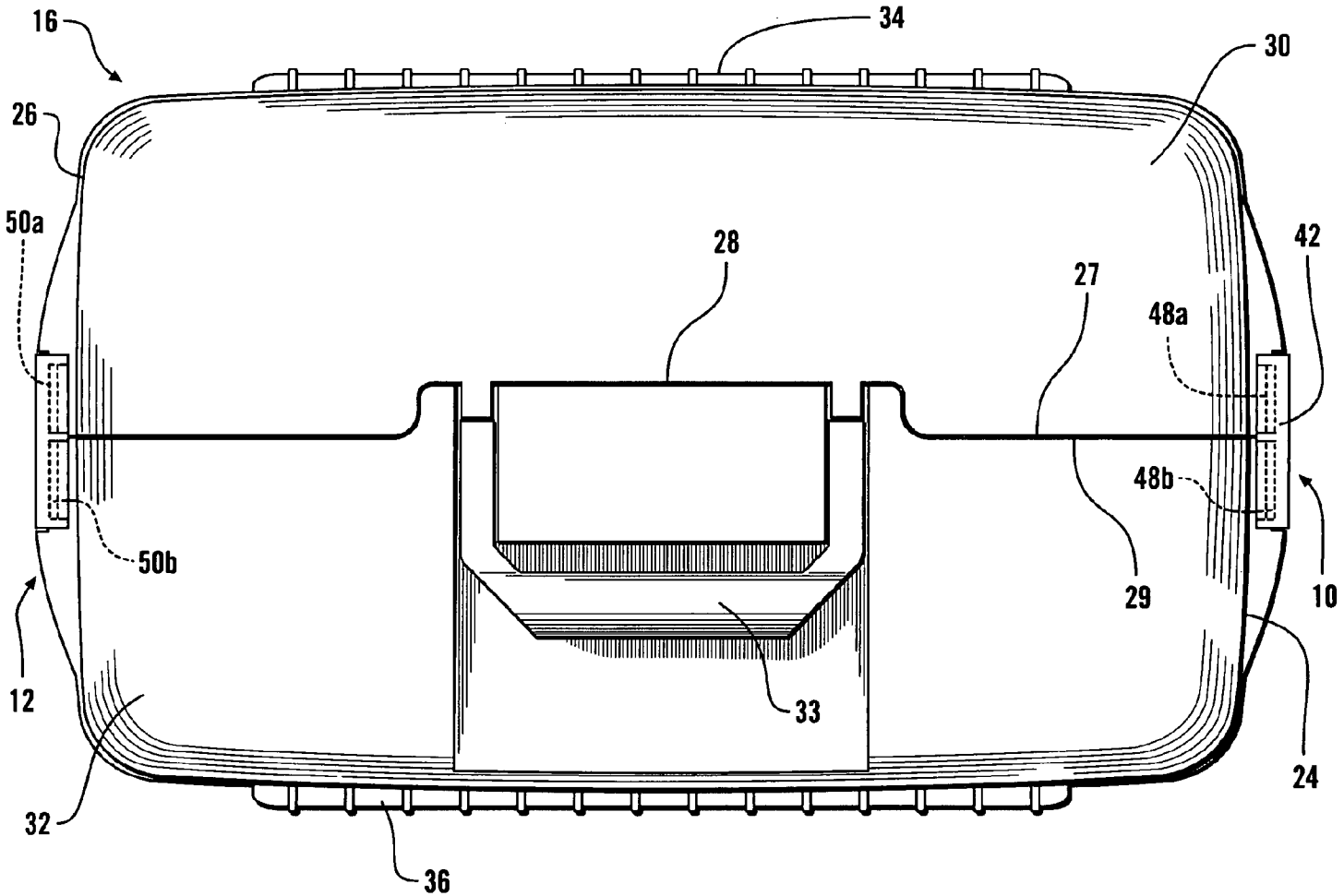
FIG. 2 is a plan view of the portable gun support case in a closed condition.
Figure 4:
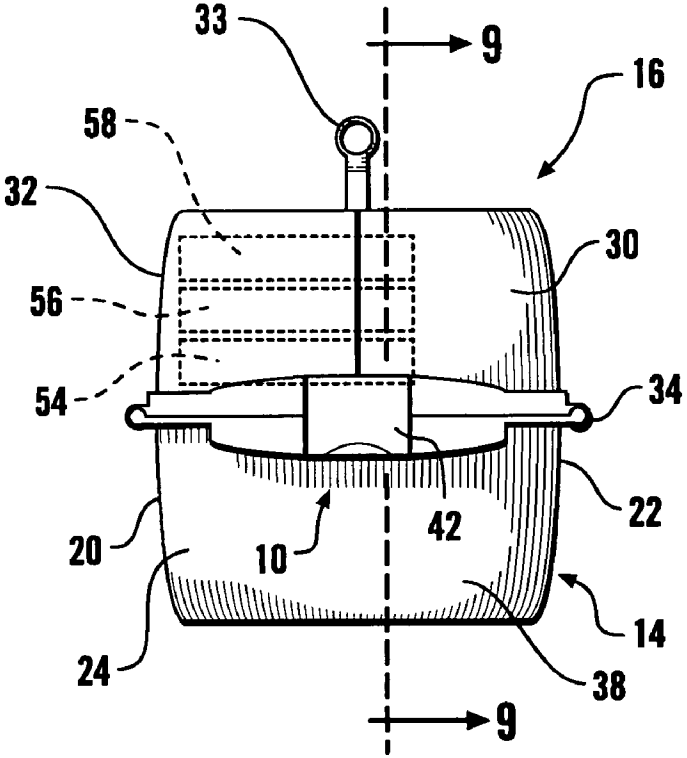
FIG. 4 is an end elevation view of the portable gun support case in a closed condition.
Figure 5:
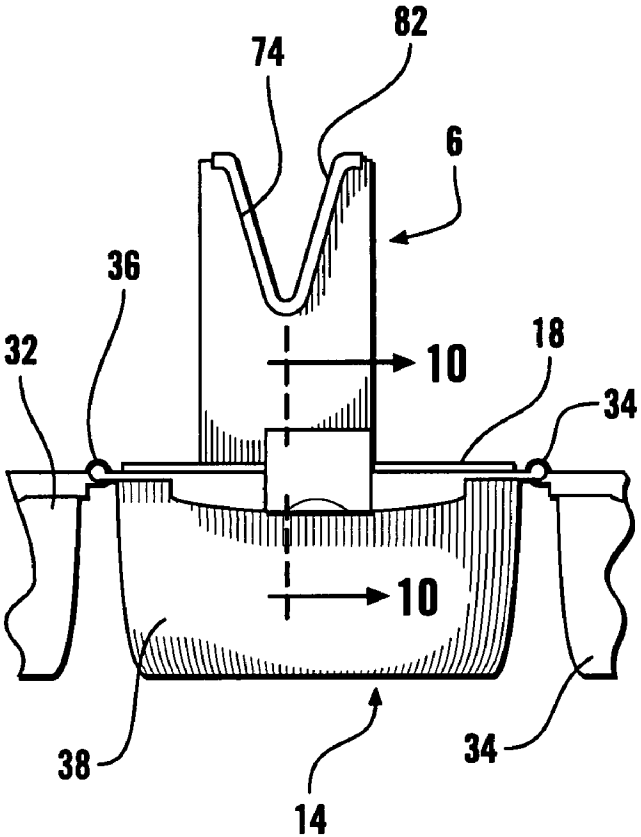
FIG. 5 is an end elevation view of the portable gun support case, with the cover members partially broken away, showing the case in an open condition and gun support members mounted on the case.

The case 4 comprises a lower elongated box 14 open upwardly when the case 4 is sitting on a level surface and an upper cover or box 16 which is open downwardly and engages the entire perimeter 18 of the lower box 14 when the case 4 is closed. The lower box 14 has a pair of longitudinal or lengthwise sidewalls 20 and 22 and a pair of facing end sidewalls 24 and 26 each connected to the lengthwise sidewalls 20 and 22. The connected sidewalls 20, 24, 22 and 26 together form the aforementioned perimeter 18 along their upper edges. The frame 5 is positioned within and affixed to the lower box 14. The cover or upper box 16 comprises two longitudinal or lengthwise halves 30 and 32 which abut at a longitudinal centerline 28 when the case 4 is closed, as shown in FIGS. 2 and 4. The upper box lengthwise halves 30 and 32 are respectively pivotally connected to lower box lengthwise sidewalls 22 and 20 by hinges 34 and 36 extending along the portion of the periphery 18 formed by sidewalls 22 and 20. Thereby, the upper box halves 32 and 34 are pivotally moveable on the hinges 34 and 36 away from each other and to the outside of the lower box 14 to place the case 4 in an open condition, as shown in FIGS. 1 and 5. A handle 33 for carrying the case 4 is pivotally affixed to half 32 of upper box 16 as shown in FIGS. 2-4.

Figure 9:
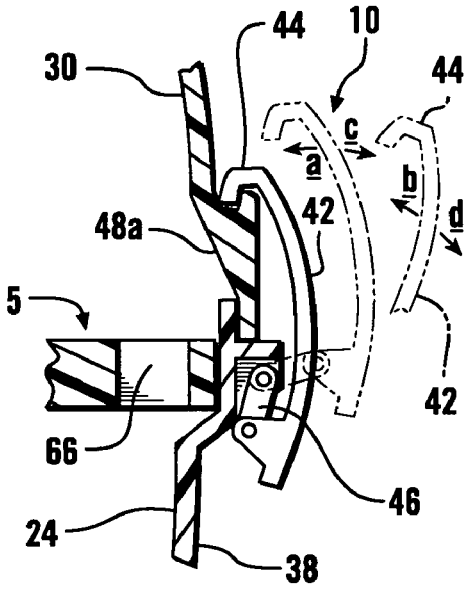
FIG. 9 is a sectional view along lines 9-9 of FIG. 4, with some parts broken away, illustrating a latch handle engaging the cover of the portable gun support case.

The retaining members 10 and 12 are respectively affixed to the lower box end sidewalls 24 and 26. As shown in FIG. 9, each retaining member includes a latch handle 42 having an upper end 44 in the shape of a downward facing hook and is pivotally connected to the lower box 14 by an over center pivoting connector 46. With reference to FIG. 2, the upper cover or box half 30 has, at its opposite ends, hook shaped projecting tabs 48*a* and 50*a* which face upward when the box half 30 is closed. Similarly, the upper cover or box half 32 has hook shaped projecting tabs 48*b* and 50*b* at its opposite ends which face upward when the box half 32 is closed. The tab 48*a* of the box half 30 and the tab 48*b* of the box half 32 are adjacent and juxtaposed when the case is closed so that they can both be engaged by a hook end 44. The tabs 50*a* and 50*b* are similarly juxtaposed so that they can both be engaged by another hook end 44. The movement in the direction of arrows a and b of a latch handle 42 to move a hook end 44 into engagement with hook tab 48*a* is shown in FIG. 9. Because tab 48*b* is juxtaposed with tab 48*a*, the latch handle 42 shown in FIG. 9 also engages tab 48*b*. Similarly, a latch handle 42 engages tabs 50*a* and 50*b*. Thus, when the case 4 is in a closed condition, the hook tabs 48*a* and 48*b*, and 50*a* and 50*b*, can be engaged by the hook ends 44 of the latch handles 42 and the latch handles pivoted to a downward position locked by the connector 46. Consequently, the upper and lower boxes are held firmly together and the case 4 is held in the closed condition. It may be noted that the over center connection of the latch handle 42 and the connector 46 and their use to lock the latch handle 42 in a position is a type of mechanism well known to persons skilled in the art.

Figure 3:
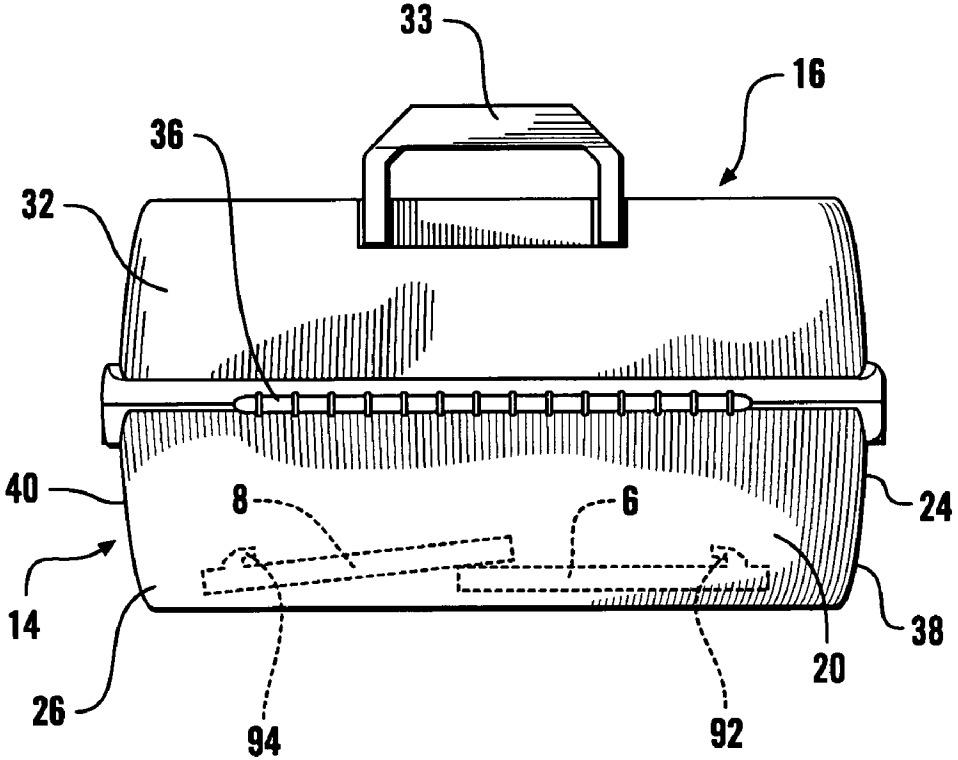
FIG. 3 is a side elevation view of the portable gun support case in a closed condition.

When the case 4 is closed, the yoke members 6 and 8 may be stored in the lower box 14, as shown in FIG. 3. Also, when the case is closed, the trays 54, 56 and 58 of the tray section 7 are in a stacked position over the lower box 14 and under the halves 30 and 32 of the upper box 16, as shown in FIG. 4. The trays 54, 56 and 58 are supported by cantilever pivot members 60 on the support frame 5 and are manually moveable into their stacked position prior to closing the case 4. When the case is opened, the trays 54, 56 and 58 may be manually moved to their cantilever stepped position as shown in FIG. 1. Access then may be had to the contents of the trays and the lower box. The trays and the lower box may be used for storage of various items such as gun cleaning accessories, ammunition and the yoke members 6 and 8, as previously mentioned.

The case 4 may be opened by pivoting the latch handles 42 outward from the lower box 14 in the direction of the arrows c and d, as shown in FIG. 9, about the over center pivoting connector 46. This movement will loosen the upper hook ends 44 of the latch handles 42 so that they can be released from the hook tabs 48*a*, 48*b* and 50*a*, 50*b* of the upper box halves 30 and 32. The upper box halves 30 and 32 can then be pivoted on the hinges 34 and 36 away from each other and to the outside of the lower box 14, as shown in FIGS. 1 and 5, to place the case 4 in an open condition.

Figure 7:
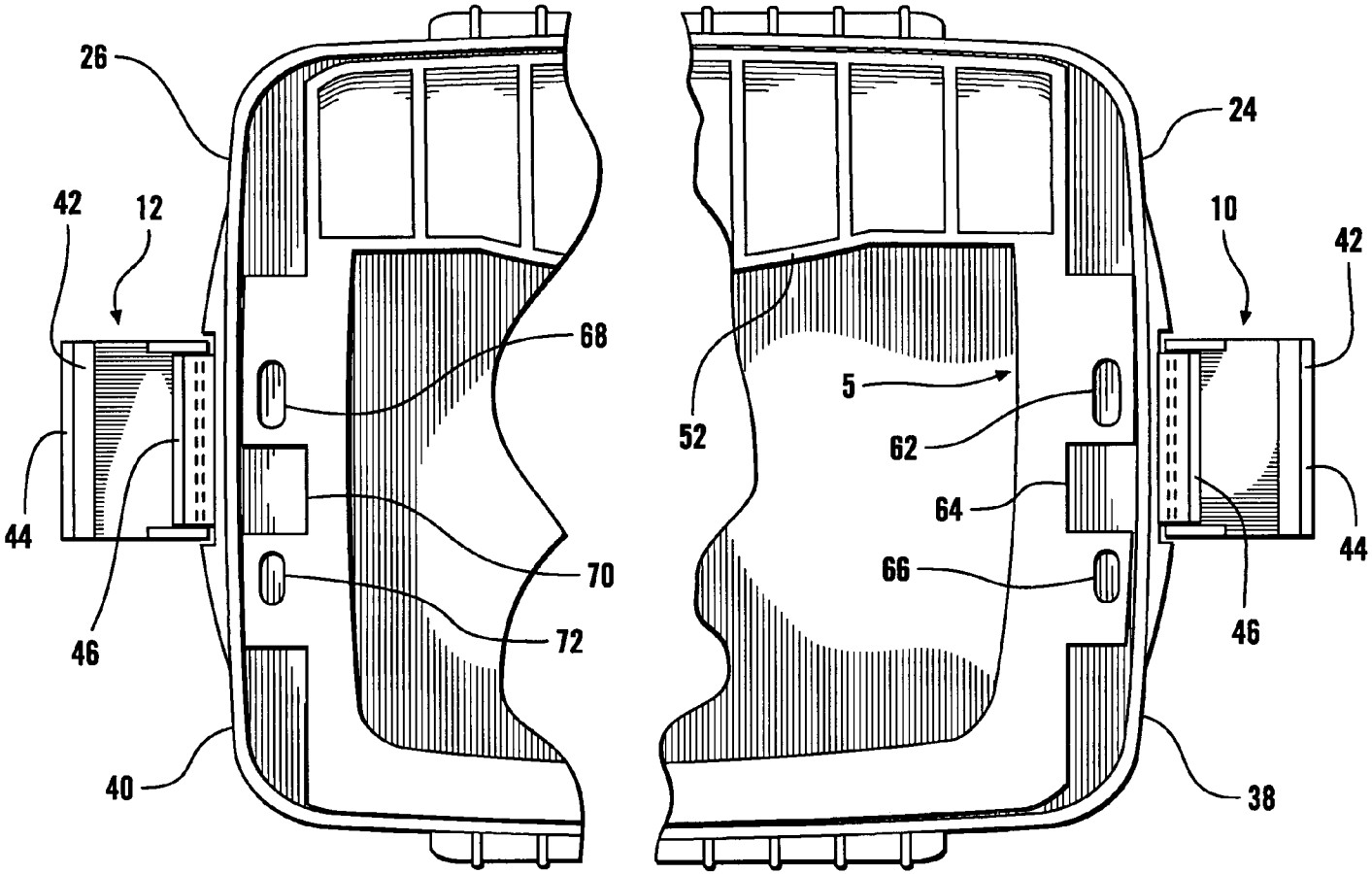
FIG. 7 is a top plan view of the gun support case in an open condition, with cover members not shown.
Figure 8:
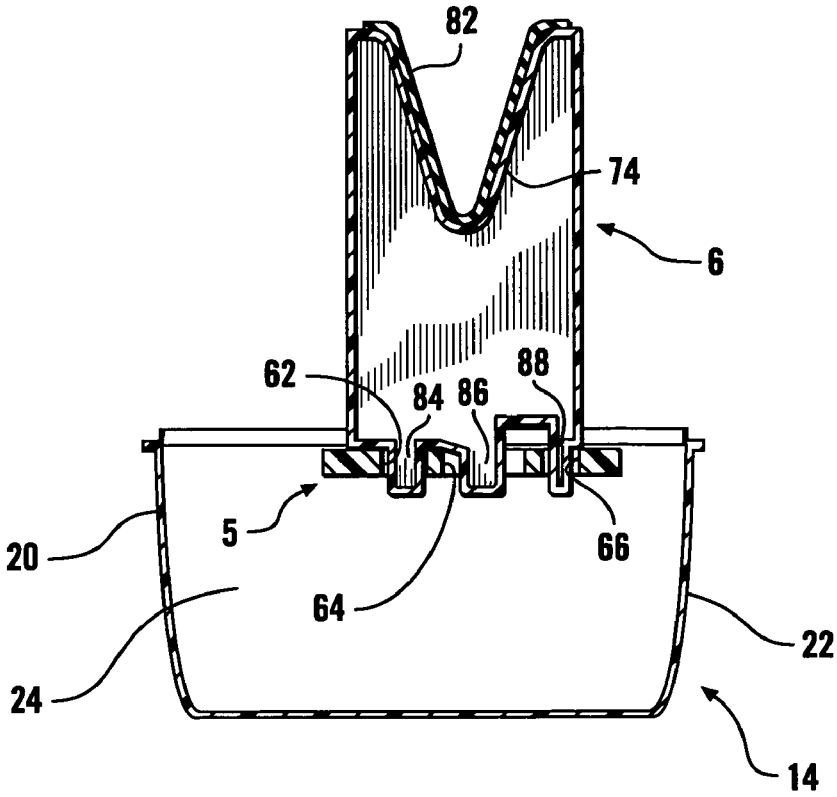
FIG. 8 is a sectional view along lines 8-8 of FIG. 6.

With reference to FIGS. 7 and 8, the support frame 5 includes a storage tray 52 and support openings 62, 64 and 66 adjacent the lower box end sidewall 24 for receiving the feet of the yoke member 6. The yoke member 6 has feet 84, 86 and 88 at its lower end which extend respectively into openings 62, 64 and 66 on the frame 5 to mount the support member 6 on the case 4. The support frame 5 also has support openings 68, 70 and 72 for receiving the feet of the yoke member 8 to mount the yoke member 8 on the case 4. Since the feet of the yoke member 8 are substantially identical to those of yoke member 6 and fit into the openings 68, 70 and 72 in the same manner as the feet 84, 86 and 88 fit into openings 62, 64 and 66, the feet of yoke member 8 will not be described in detail.

Figure 6:
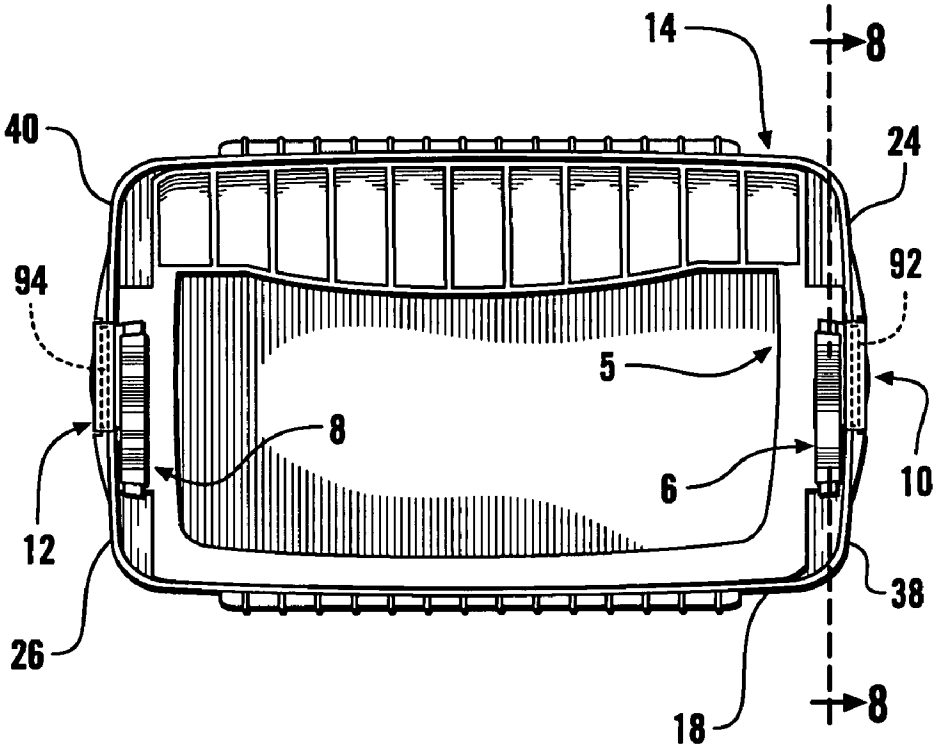
FIG. 6 is a top plan view of the gun support case, with the cover members not shown, illustrating the case in an open condition and gun support members mounted on the case.

The yoke member 6 as shown in FIGS. 1 and 5 has an upper end slot 74 shaped to receive the rear stock 78 of a gun 2 such as a rifle or shotgun. The yoke member 8, as shown in FIG. 1, has an upper end slot 76 shaped to receive the barrel 90 or fore stock 80 of gun 2. The slots 74 and 76 each have a lining strip 82 of padding material to protect the gun parts engaging the slots when the gun 2 is mounted on the yoke members 6 and 8 as shown in FIG. 1. As shown in FIGS. 1 and 6, the slots 74 and 76 are spaced apart and positioned in planes perpendicular to the length of the gun 2.

Figure 10:
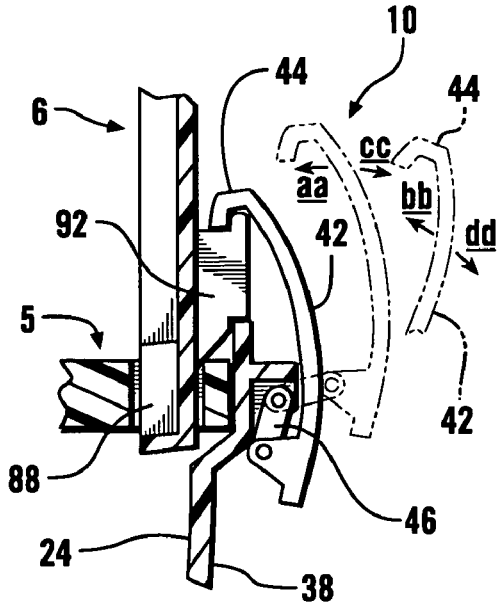
FIG. 10 is a sectional view along lines 10-10 of FIG. 5, with some parts broken away, illustrating a latch handle engaging a gun support member of the portable gun support case.

As shown in FIGS. 6 and 10, the yoke member 6 has an upward facing hook 92, when the yoke 6 is mounted on the case 4, extending intermediate its feet 84, 86 and 88 and its upper end slot 74 in a direction enabling engagement of the hook 92 with the retaining member 10. As shown in FIG. 6, the yoke member 8 has a similar upward facing hook 94, extending intermediate its feet and its upper end slot 76 in a direction enabling engagement of the hook 94 with the retaining member 12. After the yoke members 6 and 8 have been mounted in their respective openings 62, 64, 66 and 68, 70, 72, the latch handles 42 are pivoted toward the end wall 24 or 26 in the direction of the arrows aa and bb as shown in FIG. 10 to engage the hook ends 44 with hooks 92 and 94. The latch handles 42 are then pivoted to a downward position locked by the over center connectors 46 as shown in full lines in FIG. 10. The yoke members are thereby firmly held in their mounted positions on the case 4 in a manner similar to the holding of the case 4 in its closed condition. It thus may be appreciated that the retaining members 10 and 12 may be used for either holding the case 4 closed, or, when the case is open and a gun is supported, holding the yokes firmly in place.

It will be understood that the foregoing description of the present invention is for purposes of illustration only and that the invention is susceptible to a number of modifications or changes, none of which entail any departure from the spirit and scope of the present invention as defined in the hereto appended claims.

What is claimed is:

1. A portable gun support case having an open condition, comprising:

a lower box including a pair of spaced apart end sidewalls;

a pair of spaced apart yoke members each positioned adjacent a different one of the end sidewalls and extending upward from the case; and a pair of retaining members each affixed to the case on a different one of the end sidewalls and adjacent a different one of the yoke members, the retaining members each being moveable into holding engagement with the adjacent yoke member whereby each of the latter is held on the case.

2. The portable gun support case according to claim 1 wherein the pair of retaining members are each affixed to the exterior of the case.

3. A portable gun support case having a lower box and an upper box each including a pair of spaced apart sidewalls, the case having a closed condition in which the upper box faces downward toward the lower box and corresponding sidewalls of the upper and lower boxes are in engagement and an open condition in which corresponding sidewalls of the upper and lower boxes are out of engagement, comprising:

a pair of support members each extending upward from the case adjacent a different one of the lower box sidewalls when the case is in an open condition; and a pair of retaining members affixed to the case, the retaining members being adjacent a different one of the upper box sidewalls when the case is in the closed condition and adjacent a different one of the support members when the case is in an open condition, each one of the retaining members being moveable into holding engagement with the adjacent upper box sidewall when the case is in the closed condition and into holding engagement with the adjacent support member when the case is in the open condition.

4. The portable gun support case according to claim 3 wherein the retaining members are each affixed to a different one of the lower box sidewalls.

5. The portable gun support case according to claim 4 wherein the retaining members are affixed to the outside of a different one of the lower box sidewalls.

6. The portable gun support case according to claim 5 wherein each of the upper box sidewalls has a tab projecting away from the box adjacent a retaining member, the retaining members each engaging a tab to hold the case closed.

7. The portable gun support case according to claim 6 wherein each tab has a distil end extending upward and engagable by a retaining member to hold the case in a closed condition.

8. The portable gun support case according to claim 3 wherein:

the case includes a support frame adjacent each of the lower box sidewalls; and each of the support members has a bottom end and is removably mounted at its bottom end on the support frame whereby the support members may be removed from their mounted positions prior to moving the case to a closed condition.

9. The portable gun support case according to claim 8 wherein:

the lower box has a perimeter defining an upward opening; and the support frame is positioned adjacent the perimeter.

10. The portable gun support case according to claim 8 wherein:

each support member has a downwardly extending foot for mounting the support member on the support frame; and the support frame has a pair of openings therein to each receive the foot of a support member whereby the support members are held on the support frame by both the engagement of their feet in the openings and the holding engagement of the retainer members.

11. A method of holding gun supports with retaining members in position on a portable gun support case, the case having a closed and an open position and including an upward opening lower box having end sidewalls, a downward opening upper box having end sidewalls in engagement with the end sidewalls of the lower box when the case is in the closed position and disengaged and separated from the end sidewalls of the lower box when the case is in the open position comprising the steps of:

placing a gun support in an upward extending position adjacent each of the end sidewalls of the lower box when the case is in the open position;

moving a retaining member into engagement with each one of the gun supports to hold each support in its position;

removing the retaining members from engagement with the gun supports to release their hold on the supports and permit removal of the gun supports from their upward extending positions;

bringing the end sidewalls of the upper and lower boxes into engagement to place the case in the closed position; and moving a retaining member into engagement with each one of the end sidewalls to hold the case in the closed position.

12. The method according to claim 11 wherein the retaining members are affixed to the outside of the lower box and the step of placing the gun supports further comprises:

placing each gun support within the lower box; and the step of moving the retainer means into engagement with the gun supports further comprises moving each retainer from outside the lower box into engagement with a gun support.

13. A portable gun support case comprising:

a cover moveable to a closed position such that the case is in a closed condition;

a pair of retaining members affixed to the case adjacent the cover when the case is in a closed condition, the retaining members being moveable into holding engagement with the cover whereby the cover is held in a closed condition;

the cover being moveable to an open position such that the case is in an open condition;

a pair of spaced apart yoke members having a position extending upward from the case when the latter is in the open condition; and the pair of retaining members are each positioned adjacent a different one of the yoke members when the latter are in their upward extending position, each retaining member being moveable into holding engagement with the adjacent yoke member whereby each yoke member is held on the case.

14. The portable gun support case according to claim 13 wherein:

the cover comprises two sections which engage each other when the cover is closed; and each retaining member engages both sections of the cover when it is closed to hold the cover closed.

15. The portable gun support case according to claim 14 wherein the two cover sections, when in the closed position, have a pair of adjacent projecting tabs engaged by the retaining members to hold the cover closed.

16. The portable gun support case according to claim 15 wherein:

the tabs each have an upward extending hook; and the retaining members each have a downward extending hook engageable with the upward extending hook of a tab.

* * * * *